US006655395B1

(12) United States Patent
Richert

(10) Patent No.: US 6,655,395 B1
(45) Date of Patent: Dec. 2, 2003

(54) METHOD AND DEVICE FOR SCOURING AND CLEANING ROLLED STEEL STRIP

(75) Inventor: Withold Richert, Hückelhoven (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/869,663

(22) PCT Filed: Jan. 7, 2000

(86) PCT No.: PCT/EP00/00059

§ 371 (c)(1),
(2), (4) Date: Jun. 30, 2001

(87) PCT Pub. No.: WO00/42240

PCT Pub. Date: Jul. 20, 2000

(30) Foreign Application Priority Data

Jan. 15, 1999 (DE) ..... 199 01 401

(51) Int. Cl.[7] ..... B08B 3/00

(52) U.S. Cl. ..... 134/64 R; 134/67; 134/68; 134/198; 134/2; 134/3; 134/15; 134/26; 134/32; 134/34; 134/36; 134/41; 72/226; 72/231; 242/615; 242/615.2; 242/615.12; 266/102; 266/111; 266/113

(58) Field of Search ..... 134/2, 3, 15, 26, 134/32, 34, 36, 41, 64 R, 67, 68, 198; 72/226, 231; 242/615, 615.2, 615.12; 266/102, 111, 113

(56) References Cited

U.S. PATENT DOCUMENTS 5,826,818 A 10/1998 Donaud 6,210,501 B1 * 4/2001 Okano et al. ..... 148/655

FOREIGN PATENT DOCUMENTS

| | | | |
|---|---|---|---|
| AT | 284584 | | 9/1970 |
| DE | 1163634 | | 2/1964 |
| DE | 1228491 | | 10/1966 |
| JP | 363227793 A | * | 9/1988 |
| JP | 409125273 A | * | 5/1997 |

OTHER PUBLICATIONS

Patent Abstracts of Japan, vol. 011, No. 080 (C–409), Mar. 11, 1987 & JP 61 235582 A (Sumitomo Metal Ind Ltd), Oct. 20, 1986.

* cited by examiner

*Primary Examiner*—Randy Gulakowski
*Assistant Examiner*—M. Kornakov
(74) *Attorney, Agent, or Firm*—Friedrich Kueffner

(57) ABSTRACT

A device for pickling or cleaning rolled steel strip which is moved in the form of loops through several pickling and cleaning containers arranged within a treatment line, wherein at least one strip side is subjected tot he action of a pickling or cleaning medium. For this purpose, squirting or spraying units are provided which can be switched on or off and/or are adjustable with regard to their spraying width and/or are operated with controllable squirting or spraying pressure and/or volume flow. Deflection rolls for deflecting the strip are arranged before and after the treatment line for deflecting the strip out of the horizontal strip running plane into an upright vertical strip running plane and vice versa, wherein the deflection rolls are elevated or slanted relative to the horizontal strip running plane.

8 Claims, 6 Drawing Sheets

I

METHOD AND DEVICE FOR SCOURING AND CLEANING ROLLED STEEL STRIP

BACKGROUND OF THE INVENTION

1. Field of the Invention

The invention relates to a method and a device for scouring and cleaning rolled steel strip which is moved in the form of loops through several pickling and cleaning containers arranged within the treatment line, wherein, in this connection, at least one strip side is subjected to the action of a pickling or cleaning medium, for which purpose squirting or spraying units are provided which can be switched on or of f and/or are adjustable with regard to their spraying width and/or are operated with controllable squirting or spraying pressure and/or volume flow and/or changeable temperature.

2. Description of the Related Art

The necessity for and the criteria for the pickling of hot-rolled strip is disclosed sufficiently in EP 0 602 437 A1 for pickling devices of most different configurations such as deep containers, flat containers, turbo pickling devices etc. These devices are matched with regard to their pickling path to the highest strip speed and/or to the respectively most difficult steel strip to be pickled, which, however, concerns thus only exactly one pickling task. For deviating pickling tasks, for example, in the so-called turbo pickling device (compare DE 40 31 234 A), it is attempted, by changing the temperature of the pickling acid, to achieve an adaptation between the available pickling distance, strip speed, and difficulty of the steel strip to be pickled. Since, however, a temperature change is possible only slowly, it is desired to provide an immediately acting compensation via a volume stream that is more of less large and via the thus resulting turbulence.

However, as has been found for existing devices of this kind during operation, the success is only very limited. Moreover, these pickling devices require a great device length.

SUMMARY OF THE INVENTION

Another configuration of a pickling device is known from DE-AS 1 163 634. This pickling device is comprised of a tower supported on a steel frame in which the strip is guided in vertical loops and is subjected to sprayed pickling acid which is applied by nozzles arranged at several levels on both sides of the strip, which nozzles have opening slots oriented toward the strip and adjustable to the respective spraying width as a function of the width of the strip. In this connection, it is also difficult to provide an adaptation to different pickling tasks and, moreover, very tall towers (for example, 100 meters high) are generally required. Comparable configurations and constructions and arrangements are known in the case of cleaning devices.

It is an object of the invention to provide a method and a device of the aforementioned kind with which the space requirement for the pickling or cleaning devices can be considerably reduced and which, moreover, make possible an exact adaptation to the respective pickling task or cleaning task with the goal of a reduced pickling time or cleaning time and an improved pickling result or cleaning result across the strip width.

This object is solved with a method according to the invention in that the strip, before entering the prickling treatment part or cleaning treatment part, is deflected from the horizontal strip running plane into a vertical strip running plane positioned on edge and, after exiting from the pickling treatment part or cleaning treatment part, is deflected into its normal horizontal strip running plane. The deflection of the strip into an upright position on edge makes it possible to guide it in a space-saving and volume-saving way in a meander shape and to achieve a variable device configuration which allows for an optimal use of the available space. The container height is sufficient for accommodating [is determined by] the strip width, and the strip which, relative to its width, is guided in an upright or vertical arrangement about deflecting rolls, supported in the pickling containers or cleaning containers by means of vertical roll axes, is subjected, preferably on two sides, to squirting or spraying with the pickling medium or cleaning medium. The pickling containers or cleaning containers, i.e., the containers of the pickling treatment part or the cleaning treatment part, which comprises, in general, pickling or cleaning and rinsing containers as well as a dryer, can be arranged, depending on the space availability, transverse to the strip running direction or parallel to the strip running direction and thus can be arranged successively behind one another or above one another, i.e., arranged adjacent to one another in most different arrangements.

At the same time, corresponding to the strip speed and/or the steel strip to be pickled or cleaned, the exact pickling path or cleaning path can be adjusted in that more or fewer squirting or spraying beams, i.e., spraying units, are switched on or of, wherein only very minimal amounts of acid or cleaning medium and thus smallest storage containers are required. In contrast to, for example, horizontal strip guiding devices, in which the pickling or cleaning medium is entrained by adhesion forces, so that the pickling or cleaning path changes unavoidably with regard to its adjustment, the medium in the case of an on-edge guiding device of the strip flows away as much as possible in the downward direction as a result of gravity so that the adjustment is maintained. Moreover, the controllable squirting or spraying pressure and/or the volume flow of the pickling medium or cleaning medium are available unchanged as further immediately acting control members for an economical adaptation to the pickling task or cleaning task so that, in combination with the slowly changeable temperature control, an economically optimally controlled pickling device or cleaning device results. Moreover, it can be taken into account that the production or the speed, for example, of a coupled pickling/tandem cold rolling mill for thicker strip thicknesses, is not only limited by the present strip length of the employed strip but also often by the thermal output limitation of the heat exchangers for the acid. This is so because the heat transfer between the acid and the steel strip width is significantly more effective in a squirting or spraying pickling device with a rolled strip guided on edge than in an acid bath of a flat container device or turbo pickling device since hot acid is always squirted or sprayed in an economical way onto the strip surface. This makes possible an increase of the speed and thus of the production in the case of thicker strips to be pickled.

A preferred embodiment of the invention provides that across the strip width strip areas that are scaled or contaminated to different degrees are subjected to spraying with changed spraying pressure and/or changed acid concentration or cleaning concentration and/or increased volume flow of the pickling medium or cleaning medium. This targeted possible influence on the strip areas that according to experience are more strongly scaled or contaminated, such as especially on the edges of the strip, also contributes-to the reduction of the pickling time or cleaning time and thus of the pickling container length or cleaning container length.

In an advantageous device for performing the method, before and after the pickling treatment part or cleaning part, a deflecting roll is provided, respectively, which deflects the strip from the horizontal strip running plane into an on-edge vertical strip running plane and vice versa, wherein the deflection. roll is arranged elevated or slanted relative to the horizontal. When being deflected at the beginning of the device, the strip enters vertically from the bottom or the top and, behind the device, it exits vertically in the downward direction or in the upward direction, wherein the deflecting rolls are elevated or slanted preferably by 45° relative to the horizontal.

According to an advantageous embodiment, the deflecting rolls have correlated therewith tensioning roll sets supported on vertical axes which secure the strip at the center of the device, wherein the required strip tension is generated by the vertically acting friction forces between the rolls and the strip.

In this context, it may be expedient that at least one of the strip deflection rolls arranged within the pickling or cleaning containers is configured as a control roll and/or pressing rolls are preferably correlated with the strip deflection rolls. The control roll or rolls, of which, depending on the length of the pickling container or the length of the cleaning container, one or more are provided, serve for providing a possible correction of the strip running action. The deflection rolls, provided with an additional drive primarily in the case of thicker strip thicknesses and long pickling containers or cleaning containers, compensate strip tension losses resulting from bending and support the maintenance of the required strip tension.

In order to prevent that upon strip tension loss, as in the case of electrical blackout, the strip slips out of the center of the device, the pressing rolls press the strip with such a force against the deflection rolls that the strip is supported by means of the perpendicularly acting friction force. In this connection, a further advantage resides in that the cooperation of the deflection roll with the pressing roll squeezes off possibly entrained acid and thus makes possible a cascade guiding of the pickling acid or the cleaning solution.

According to an advantageous configuration of the invention, at least the first pickling container or cleaning container positioned in the strip running direction is provided with ultrasound actuators. They increase the removal speed of the scale layer or contamination layer from the strip surface.

In this connection, it is expedient that the ultrasound actuators are arranged in a narrow separate chamber delimited by sealing rolls at the inlet und outlet sides, in particular, advantageously distributed about the strip width behind acid-resistant or base-resistant partitions at the end face of the chamber, respectively. The separate chamber is formed by means of the sealing rolls on the running strip, i.e., is separated within the respective pickling container or cleaning container. This provides the possibility of flooding the chamber continuously with acid or cleaning fluid for coupling the sound energy and to thus enhance the transmission of the sound energy onto the strip surface.

BRIEF DESCRIPTION OF THE DRAWING

In the drawing

Further features and advantages of the invention result from the claims and the following description in which some embodiments of the subject matter of the invention are explained in more detail. It is shown in:

DETAILED DESCRIPTION OF THE INVENTION

Figure 1:
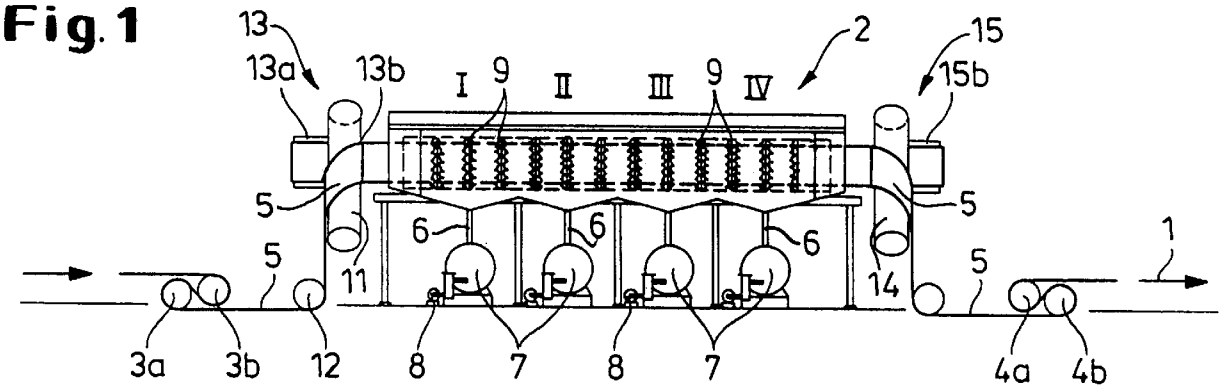
FIG. 1 the pickling treatment part as a detail of the strip treatment device, coupled optionally to a rolling mill arranged downstream, in a schematic longitudinal view.
Figure 2:
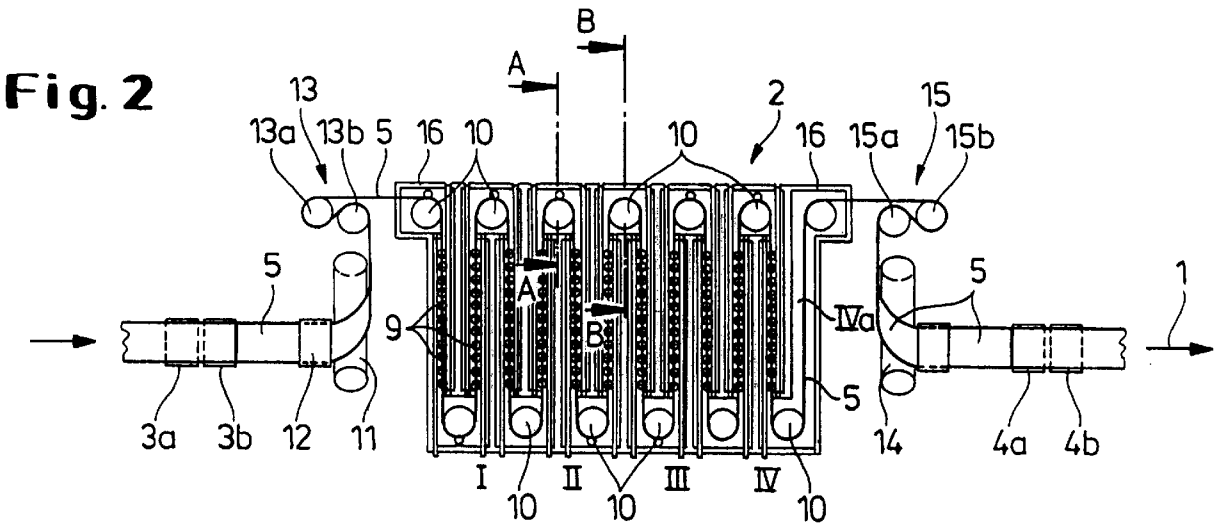
FIG. 2 the pickling treatment part in a plan view.

FIG. 1 shows substantially only the pickling treatment part or cleaning treatment part 2 of a strip treatment device, not illustrated in detail, with strip running direction 1 (compare the arrow in FIG. 2). Shown are also the last or first rolls 3*a*, 3*b* or 4*a*, 4*b* of an S-roll stand arranged in front and behind the pickling part or cleaning part 2. In the embodiment, the pickling part or cleaning part 2 comprises three pickling containers or cleaning containers I, II, III followed by a container IV for rinsing and drying the metallic strip 5 guided therethrough and to be pickled or cleaned. The individual containers I to IV are connected by supply and return lines 6 to reservoirs 7 storing the required acid amount or cleaning solution amount and having correlated therewith pumps 8 for conveying the acid or the cleaning solution for application onto the strip surface. They supply the squirt or spray beams 9, arranged in the pickling containers or cleaning containers to both sides and transversely to the strip running direction, which beams are embodied in the embodiment (compare FIGS. 7 and 8) as tubes with spray nozzles 18 arranged therein and directed onto the surface of the strip and producing a desired spray pattern 19. The squirt or spray beams 9 and their nozzles 18 can moreover be selectively switched on and off and adjusted to the respective strip width 20 and embodied such that target areas of the metallic strip which are especially strongly scaled or contaminated are subjected to squirting or spraying either with higher spraying pressure and/or changed acid volume or cleaning solution volume, changed acid temperature or cleaning solution temperature and/or with acids or cleaning solutions of different acid concentrations or cleaning solution concentrations. For an optionally discontinuous operation of the device, the squirting or spraying beams 9 can also be completely switched off.

The metallic strip 5 is guided relative to its width in an upright or on-edge arrangement in a meander shape (compare FIG. 2) about deflection rolls 10 arranged on vertical axes [21], i.e., mounted upright in roller bearings, within the pickling chambers or cleaning chambers I to IV. For positioning the metallic strip 5 in its upright position, a horizontal deflection roll 12 and an intake [defection] deflection roll 11, elevated or slanted relative to the horizontal by 45°, are arranged upstream of the pickling part or cleaning part 2. The strip 5 is guided vertically upwardly or downwardly from the horizontal deflection roll 12 to the intake deflection roll and from there to a tensioning roll set 13 whose tensioning rolls 13*a*, 13*b* are supported upright, i.e., are supported in vertical axes, via which the strip 5 is then moved through the individual containers I to IV of the pickling part or cleaning part 2.

At the end—exit side—of the pickling part or cleaning part 2 an exit deflecting roll 14 is arranged which is also elevated or slanted approximately by 45° relative to the horizontal, and onto which the pickled or cleaned strip 5 is guided downwardly or upwardly, coming form a tensioning roll set 15 comprising two tensioning rolls 15*a*, 15*b* supported on vertical axes, and which returns the strip 5 into the horizontal strip running plane so that the treated strip can be subsequently coiled or introduced immediately into a rolling mill arranged downstream.

The strip 5 which is guided in a meander shape in an upright or on-edge position relative to its width through the pickling containers or cleaning containers I to IV makes it possible to realize the device configuration in most different ways and arrangements of the pickling containers or cleaning containers I to IV in order to utilize the available space in an optimal way.

In the embodiment according to FIGS. 1 and 2 with pickling containers or cleaning containers I to IV arranged transversely to the strip running direction 1, the strip 5 enters through the lid 16 of the first container I and leaves the last container IV, having an area for rinsing and drying, also through the lid 16. The individual containers I to IV are positioned parallel and successively in this embodiment.

Figure 3:
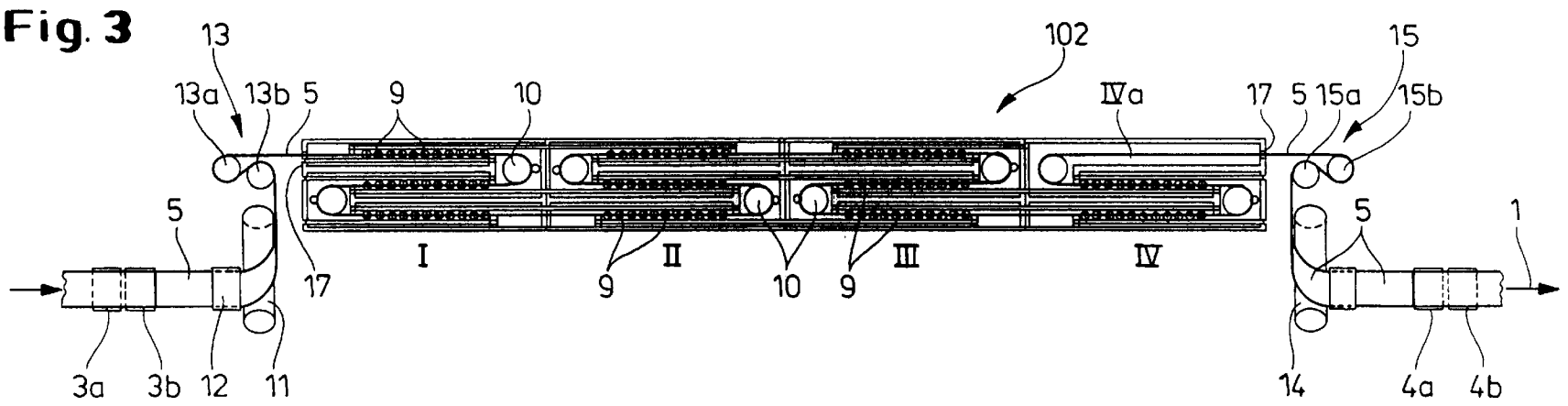
FIG. 3 a variant of the pickling treatment part with containers arranged successively in a row, shown in a plan view.
Figure 4:
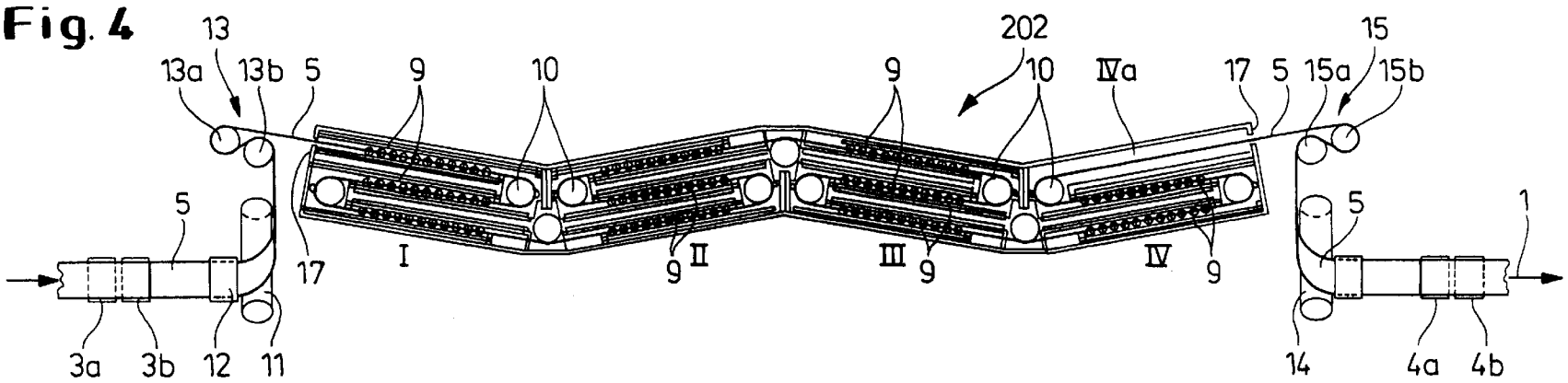
FIG. 4 in a schematic plan view a modification relative to FIG. 3 with containers successively connected in a zigzag arrangement.

In the variants of the pickling or cleaning treatment parts 102 or 202 as well as 302 and 402 according to FIG. 3 and 4 or 5 and 6, the containers I to IV are positioned parallel to the strip running direction 1, wherein the strip 5 enters and exits the treatment part at the inlet side and the outlet side through the respective container sidewall 17, respectively. In the variant according to FIGS. 3 and 4, the containers I to IV of the pickling or cleaning treatment parts 102 or 202 are arranged successively in a row wherein the embodiment according to FIG. 4 shows a zigzag arrangement of the containers.

Figure 5:
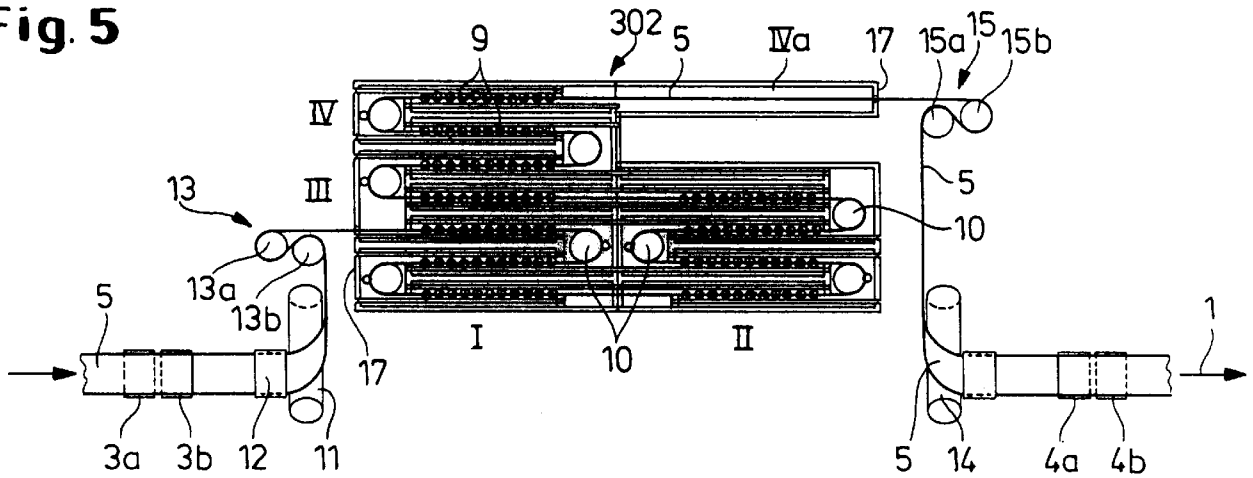
FIG. 5 in a plan view a different embodiment with containers arranged parallel to the strip running direction and thus arranged above and adjacent to one another.
Figure 6:
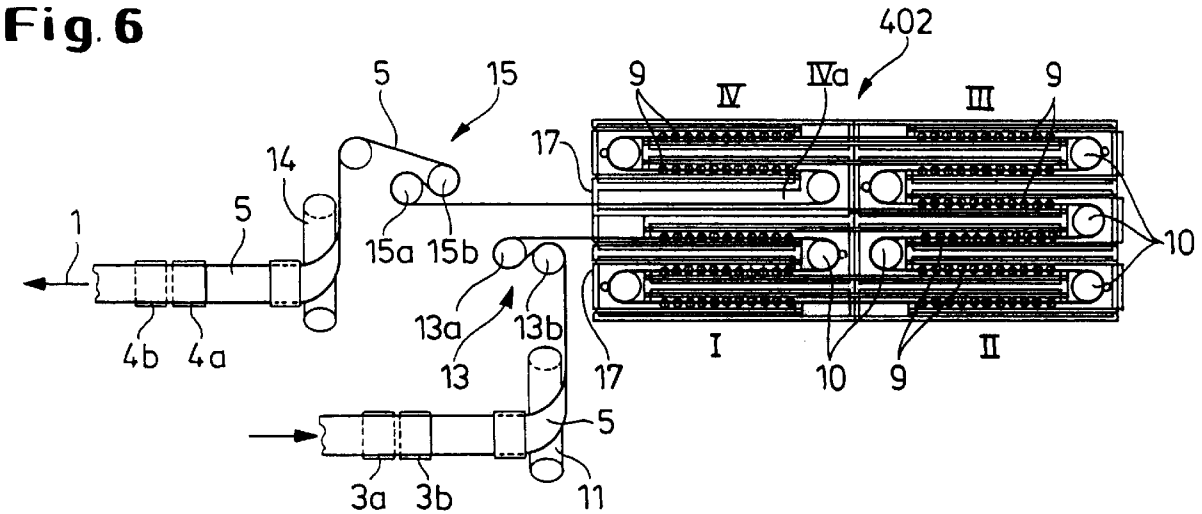
FIG. 6 in a plan view a modification of the container arrangement illustrated in FIG. 5.

In the modifications of the pickling or cleaning treatment parts 302 or 402 in a compact arrangement according to FIGS. 5 through 6, the containers I and II are arranged successively, respectively, and the containers 3 and 4—viewed in the plane of the drawing—are arranged thereabove wherein the strip 5 in any case exits the last container IV from the dry area provided therein, the same also holding true for the arrangements according to FIGS. 1, 2 and 3. As a result of the container arrangement of FIG. 6—in deviation of all other embodiments—the strip 5 enters and exits at the same side of the pickling or cleaning treatment part 402. Aside from the different arrangement and position of the containers I to IV or IVa, the other components do not differ from those of FIGS. 1 and 2 so that these identical components in all embodiments are provided with the same reference numeral.

Figure 7:
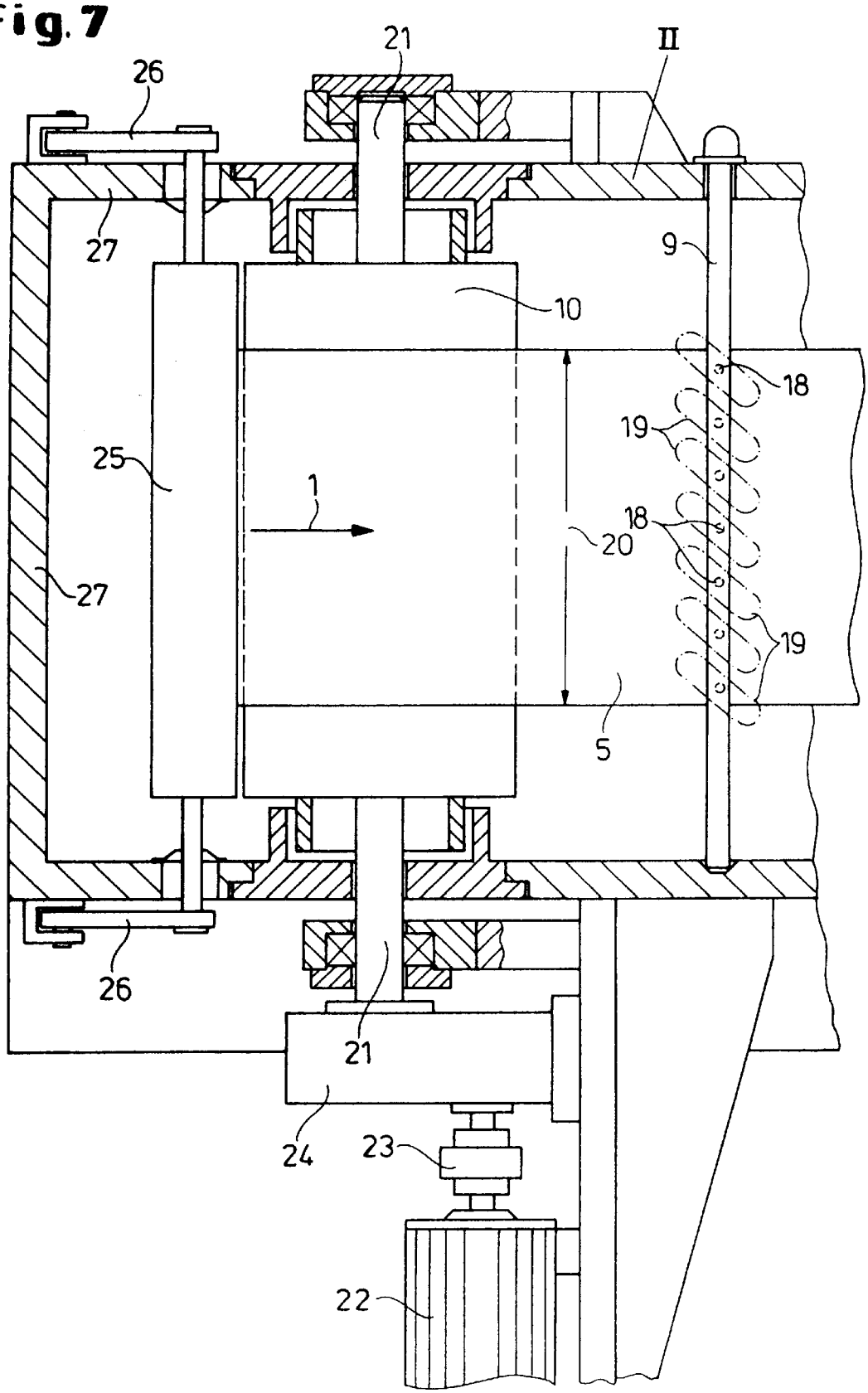
FIG. 7 a section along the line A—A of FIG. 2.
Figure 8:
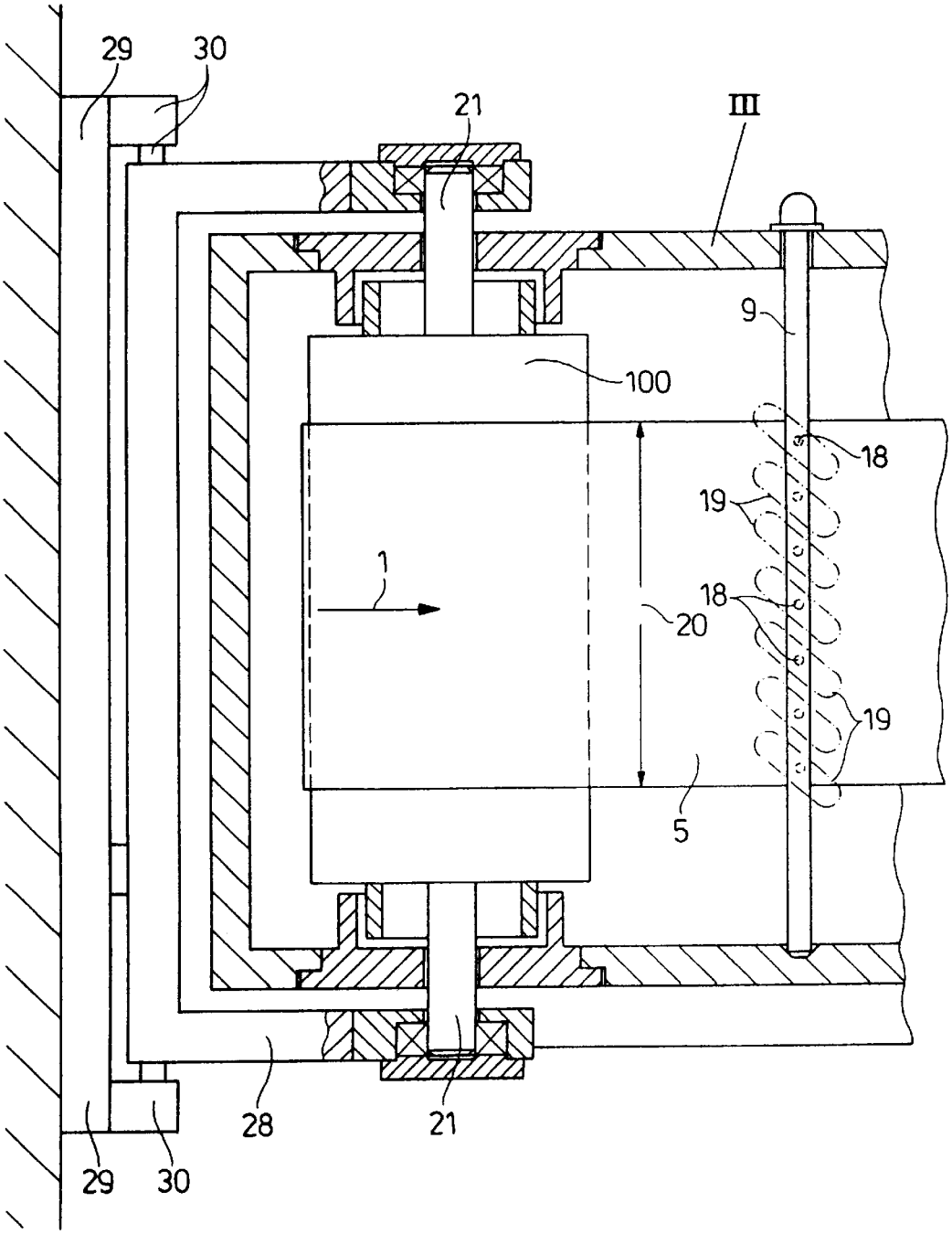
FIG. 8 a section along the line B—B of FIG. 2.

In FIGS. 7 and 8 details of constructive advantageous embodiment of the pickling containers I to IV are illustrated, wherein, according to FIG. 7, a pressing roll 25 is correlated with the deflection roll 10, which is connected to a drive 22 via a coupling 23 and a gearbox 24, wherein the pressing rolls supported by means of a pivot lever 26 on a frame 27. In the variant according to FIG. 8, the deflection roll is configured as a control roll 100 and, for this purpose, is arranged or supported on a pivot frame 28 which, in turn, is received by a base frame 29 fastened on the steel construction and having guides 30 for the pivot frame 28. The strip 25, relative to FIG. 7, has a [reduced] smaller strip width 20 and fewer spray nozzles 18 are therefore switched on.

Figure 9:
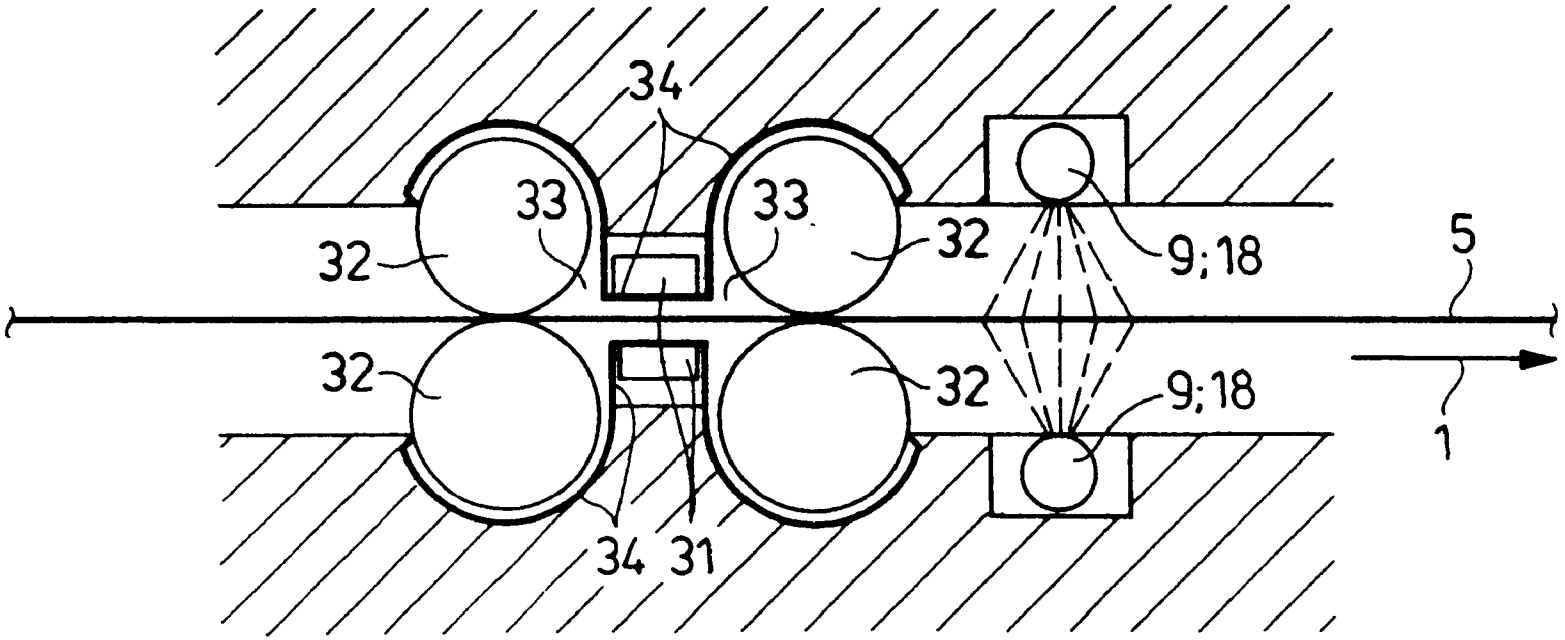
FIG. 9 a chamber delimited by sealing rolls and with ultrasound actuators arranged therein, schematically shown as a detail.

For increasing the removal speed of scale or contaminants on the surface of the strip 5, according to FIG. 9 several ultrasound actuators 31 are provided at least in the first container I in the strip running direction 1. They are arranged in a narrow separate chamber 33 delimited by inlet and outlet sealing rolls 32 behind acid-resistant or base-resistant partitions 34, respectively.

What is claimed is:

1. A device for pickling or cleaning rolled steel strip which is moved in the form of loops through several pickling and cleaning containers arranged within a treatment line, comprising squirting or spraying units for subjecting at least one strip side to a pickling or cleaning medium, wherein the squirting or spraying units are configured to be switched on or off and/or are adjustable with regard to a spraying width thereof and/or are operated with controllable squirting or spraying pressure and/or volume flow, further comprising a deflection roll for deflecting the strip before the treatment line out of a horizontal strip running plane into an upright vertical strip running plane, and another deflection roll for deflecting the strip after the treatment line out of the upright vertical strip running plane into the horizontal strip running plane, wherein the deflection rolls are elevated or slanted relative to the horizontal strip running plane.

2. The device according to claim 1, wherein the deflection rolls are correlated with tension roll sets supported on vertical axes.

3. The device according to claim 1, comprising at least one strip deflecting roll arranged in the pickling containers or cleaning containers and configured as a control roll.

4. The device according to claim 1, comprising at least one strip deflecting roll arranged in the pickling containers or cleaning containers, wherein the at least one strip deflecting roll is additionally driven.

5. The device according to claim 4, wherein the strip deflecting roll comprises pressing rolls.

6. The device according to claim 1, wherein the pickling containers or cleaning containers include at least a first pickling or a cleaning container in a strip running direction, wherein the first pickling or cleaning container comprises ultrasound actuators.

7. The device according to claim 6, wherein the ultrasound actuators are arranged in a narrow separate chamber delimited by sealing rolls provided at an inlet side and an outlet side.

8. The device according to claim 7, wherein the ultrasound actuators are distributed across a strip width behind acid-resistant or base-resistant partitions at end faces of the chamber.

* * * * *